United States Patent [19]

Livingston

[11] Patent Number: 4,744,279

[45] Date of Patent: May 17, 1988

[54] ADJUSTABLE DRUM PEDAL DEVICE

[76] Inventor: Duane P. Livingston, 1447 S. Saltair, Apt. 210, Los Angeles, Calif. 90025

[21] Appl. No.: 869,106

[22] Filed: May 30, 1986

[51] Int. Cl.[4] ..... G10H 3/14; G10H 5/00

[52] U.S. Cl. ..... 84/1.01; 84/422 R; 84/DIG. 12; 84/DIG. 24

[58] Field of Search ..... 84/1.01, 1.04, 422 R, 84/DIG. 12, DIG. 24

[56] References Cited

U.S. PATENT DOCUMENTS 4,160,400 7/1979 Schrecongost ..... 84/DIG. 7

4,200,025 3/1980 Currier ..... 84/1.01

*Primary Examiner*—Stanley J. Witkowski

*Attorney, Agent, or Firm*—Pretty, Schroeder, Bruggemann & Clark

[57] ABSTRACT

A drum pedal device for immediately and accurately triggering and controlling a synthesizer. The device includes a movable pedal, which can be a foot pedal, an actuation device which actuates a transducer to supply an electrical signal to the synthesizer upon movement of the pedal, and a resisting mechanism which resiliently resists overtravel movement of the pedal after the transducer is actuated. The resisting mechanism opposes the movement of the pedal with increasing force as the overtravel movement of the pedal progresses. The foot pedal can be pivotally mounted on a base and the device can have a biasing mechanism for controlling and imparting bouncing and rocking motion to the foot pedal.

18 Claims, 2 Drawing Sheets

ADJUSTABLE DRUM PEDAL DEVICE

FIELD OF THE INVENTION

This invention relates generally to drum pedal devices, and, more particularly, to drum pedal devices which trigger and control synthesizers, such as drum synthesizers, that produce synthesized percussive sounds, including sounds which simulate those made by an acoustic drum.

BACKGROUND OF THE INVENTION

A number of drum pedal devices are known which trigger and control the production of musical sounds by percussion instruments. They allow a musician to be more versatile by freeing his hands to play other musical instruments. One such device is known as an acoustic drum pedal which is typically used to operate an acoustic bass drum. It includes a pedal that actuates a beater, causing it to strike the membrane of the bass drum. By way of example, forms of such devices are described in U.S. Pat. No. 3,797,356 to Duffy, et al., and U.S. Pat. No. 3,967,523 to Currier, et al. Improvements on devices of this nature are described in my previous patent, U.S. Pat. No. 4,538,499.

These known devices do, however, have disadvantanges. They are generally usable only with conventional acoustic percussion instruments and, therefore, only trigger and control the product of sounds by the instruments, i.e., acoustic sounds rather than synthesized sounds. On the other hand, electronic percussion instruments, such as drum synthesizers and electronic drums, which convert acoustic sounds or vibrations into synthesized percussive sounds, have proliferated the field of music. Many musical compositions are now characterized by synthesized percussive sounds.

Since a number of these electronic percussion instruments contemplate the use of pedal devices to trigger and control the production of synthesized percussive sounds, there has arisen a need for a pedal device which can achieve these results without sacrificing certain advantages associated with common acoustic drum pedals used on acoustic drums. One approach toward meeting this need has been to modify the common acoustic drum pedal such that it also includes a sounding block mounted on a vibration pickup. When the beater strikes the block, the pickup generates an electrical signal which is transferred to a synthesizer, thereby producing synthesized percussive sounds. By way of the example, one form of such device is described in U.S. Pat. No. 4,200,025 to Currier, et al.

Another approach has been to use the common drum pedal, clamped to the common electronic drum pad. The drum pad generally comprises a flat, hard surface, such as wood or plastic, which can be rubber or plastic coated, that is mounted on a vibration pickup. The hard surface approach can be an effective way of transmitting reasonably dynamically sensitive signals to the synthesizer.

These types of devices, however, have a number of drawbacks. They tend, for instance, to impair the playing style of the musician and cause a musician's ailment commonly known as "drum pad knee." These difficulties at least partially stem from the fact that when the rather hard head of the beater strikes the rather hard surface of the pad very little elastic deformation results at the point of impact. As a result, it tends to lack the overall "natural feel" which is characteristic of high quality acoustic drum pedals used on acoustic drums.

Another approach has involved the placement of pickup devices, such as electrical transducers, on the drum head of a drum. When the membrane of the drum is struck, these devices convert the acoustic vibrations of the membrane into electronic signals that may be electronically processed to generate percussion sounds. A variation of such pickup devices can also include a mechanism for filtering out extraneous vibrations. By way of example, forms of such devices are described in U.S. Pat. No. 3,659,032 to May and U.S. Pat. No. 4,226,156 to Hyakutake.

This approach, too, has a number of disadvantages. It often only permits amplification, rather than synthesization, of an electrical signal, and provides a signal that includes extraneous vibrations. The devices also tend to fail to sense and convert the acoustic vibrations accurately enough. As a result, the playing style of the musician is impaired and the quality of percussion sounds is adversely affected.

Accordingly, there is a need for a drum pedal device which has adequately adjustable playing positions, which is capable of accurately triggering and controlling the production of synthesized percussive sounds by synthesizers without at the same time tending to produce "drum pad knee" or impair the musician's playing style, and which emulates the "bouncing and rocking" motion and overall "natural feel" of a high quality acoustic drum pedal used on an acoustic drum.

SUMMARY OF THE INVENTION

The present invention, which addresses the above need, is embodied in a drum pedal device for immediately and accurately triggering and controlling a synthesizer and, more particularly, a type of synthesizer that produces synthesized percussive sounds. The device includes a movable pedal, which can be a foot pedal, an actuation device which actuates a transducer to supply an electrical signal to the synthesizer upon movement of the pedal, and a resisting mechanism which resiliently resists overtravel movement of the pedal after the transducer is actuated. A base can also be pivotally connected to the foot pedal. The resisting mechanism opposes the movement of the pedal with increasing force as the overtravel movement of the pedal progresses. As such, the device tends to emulate the performance characteristics of a high quality acoustic drum pedal used on an acoustic drum and to minimize the occurrence of "drum pad knee."

In one embodiment of the invention, the transducer is attached to the base and the actuation device and resisting mechanism are connected together and are movable with the pedal. The transducer can be contained within a housing and can be seated on a shock pad which in turn sits on a support plate. The shock pad tends to eliminate extraneous vibrations which might otherwise be sensed by the transducer and to reduce the possiblity of damage to the transducer caused by sudden, repetitious impacts. The resisting mechanism includes a leaf spring and the actuation device includes a striker that is attached to one end of the leaf spring.

The device can also have a second biasing element and an adjustable biasing mechanism. The second biasing element, which includes a spring capped on each end by an annular stud, is generally located toward the rear of the pedal and advantageously, but not necessarily, is secured to both the pedal and the base. To accommodate the second biasing element, the base and the pedal can also define a series of longitudinally spaced bores which can selectively receive the second biasing element at various points along the longitudinal axis of the base and the pedal. The second biasing element tends to permit the musician to better control and impart bouncing and rocking motion to the pedal and, therefore, gives the device more of the "natural feel" of a high quality acoustic drum pedal.

The adjustable biasing mechanism is secured to the base and faces the pedal such that it can arrest the downward movement of the pedal at selected stages of the pivotal movement of the pedal relative to the base. It includes an externally threaded disk which is secured to the base and faces the pedal and an adjustable spring which is capped at one end by an internally threaded disc which is threaded onto the threaded member. As such, it is possible to adjust the position of the spring by simply threading the disc along the threaded member. In order to prevent the internally threaded disc from slipping, the adjustable biasing mechanism can also include a mechanism for locking the adjustable spring in place. A shock pad can also be attached to the pedal at a location opposite the free end of the spring in order to reduce noise and to cushion the shock to the adjustable biasing mechanism from frequent impacts with the pedal. The adjustable biasing mechanism permits the musician to effectively adjust the arresting of the downward movement of the foot plate at selected stages of the pivotal movement of the foot plate, such that the device better accommodates a particular playing comfort and style.

In another embodiment of the invention, the transducer is attached to the base and can have the housing and shock pad arrangement described in the previous embodiment. Further, like the previous embodiment the actuation device and resisting mechanism are connected together and are movable with the pedal. Here, however, the resisting mechanism includes a resilient biasing element capped on one end by an energy absorbing member, and the actuation device includes a striker which caps the other end of the biasing element. Further, the biasing element surrounds a guiding pin which tends to stabilize the actuation device and retain the shape of the biasing element. Moreover, the second biasing element and the adjustable biasing mechanism can also be incorporated as discussed above.

In still another embodiment, the device is somewhat similar to that described in the previous embodiment, except that the positions of the striker and transducer are reversed and the housing-shock pad arrangement is not used. That is, the striker is attached to the base, rather than to the pedal, and the transducer and resisting mechanism are now attached together and movable with the pedal. More particularly, the resilient biasing element of the resisting mechanism is now capped on one end by the transducer and on the other end by an energy absorbing member. When the pedal is depressed the transducer impacts the striker thereby supplying an electrical signal to the synthesizer. A guiding pin may also be included as stated above. Further, the second biasing element and the adjustable biasing mechanism can also be incorporated as discussed above.

In still another embodiment, the device is somewhat similar to that described in the previous embodiment except for positional adjustments to the striker, transducer and resilient biasing element. More particularly, the striker is attached to and movable with the pedal, while biasing element and the transducer are connected to the base. That is, the biasing element is capped on one end by the transducer and on the other end by a plate, rather than an energy absorbing member, which faces the striker. As such, the striker does not directly make contact with the transducer. When the pedal is depressed the striker impacts the plate, which transmits vibrational energy to the transducer. A second biasing element and an adjustable biasing mechanism can also be included as in the previous embodiment.

Other features and advantages of the present invention will become apparent from the following description of the preferred embodiments, taken in conjunction with the accompanying drawings, which illustrate by way of example, the principles of the invention.

DESCRIPTION OF THE PREFERRED EMBODIMENTS

Figure 1:
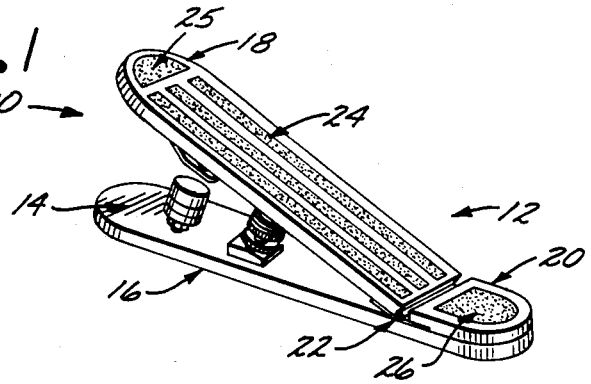
FIG. 1 is a perspective view of the pedal device according to the present invention.
Figure 2:
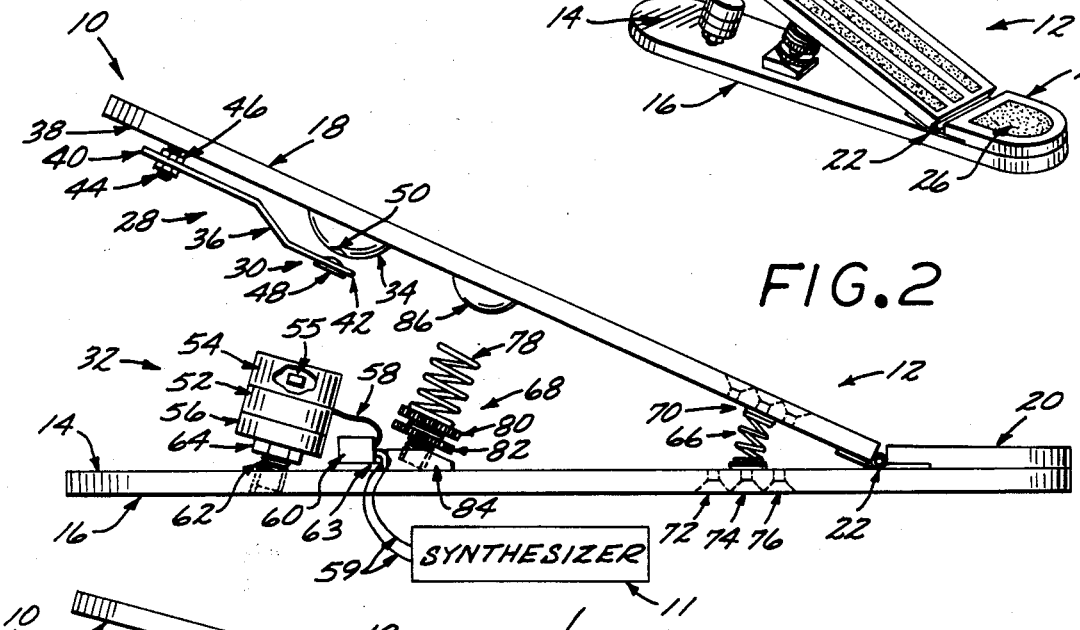
FIG. 2 is a side view of the device of FIG. 1 in a rest position.

A drum pedal device 10 for triggering and controlling the production of synthesized percussive instrument sounds by a synthesizer 11 (not drawn to scale), according to the present invention, includes a footboard, or foot pedal, 12 that is connected to a base 14 which rests on playing surface 16. As shown in FIGS. 1 and 2, the foot pedal 12 includes a separate foot plate 18 that is pivotally connected to a heel plate 20 by a suitable latch mechanism 22. Although the foot pedal 12 shown is shaped somewhat like the sole and heel of a common shoe, it will be appreciated that other shapes, such as that of a rectangular plate, can be used. Further, the foot pedal 12 can be of unitary or one piece construction. The surface of the base 14, which abuts the playing surface 16, has a rubberized traction pad (not shown) having separate transverse rubber ridges to provide improved frictional contact with the user's foot.

The top surfaces of the foot plate 18 and the heel plate 20 have, respectively, a series of parallel, traction strips 24, which can be rubberized, and an adhesive pad 25 and traction pads 26, which can be rubberized to prevent the musician's foot from slipping during operating conditions. The heel plate 20 also flushly and securely abuts the base 14, while the latch mechanism is secured to the base 14 and foot plate 18 by bolts (not shown).

In accordance with one embodiment of the present invention, shown in FIG. 2, the means by which the device 10 triggers the synthesizer 11 includes a resisting mechanism 28 and an actuation device 30, which are connected together and are movable with the pedal 12, and a synthesizer trigger 32. The resisting mechanism 28 is embodied in a semi-cylindrically shaped, rubberized stop or cushion 34 and a flexibly mounted leaf spring 36. The cushion 34 tends to reduce the shock which the user of the device experiences upon impact of the actuation device 30 with the synthesizer trigger 32. It also tends to prevent the leaf spring 36 from reverberating so that it does not accidentally activate the synthesizer trigger 32 twice or more times in response to a single depression of the foot plate 18. The cushion 34 contains a centrally disposed cavity 50 and is connected to the underside 38 of the upper portion of the foot plate 18.

The leaf spring 36 is situated such that part of it is interposed between the cushion 34 and the synthesizer trigger 32. More particularly, the leaf spring 36 has first and second end portions 40 and 42 respectively which have bores (not shown). The bore on the first end portion 40 receives a threaded bolt 44 with a nut 46 threaded onto its stem, while the bore on the second end portion 42 receives the actuation device 30 which can be any suitable striker such as a threaded bolt (not shown) capped by a nut 48. The first end portion 40 of the leaf spring 36 is secured by the bolt 44 to the underside 38 at a point above the stop or cushion 34 such that the actuation device 30 can be received within the cavity 50 of the cushion 34 in countersunk fashion. The actuation device 30 serves to focus the force transferred to the synthesizer trigger 32. As such, when the device 10 is in the rest position, shown in FIG. 2, the leaf spring 36 is spaced apart from the cushion 34. Conversely, during operation, the actuation device 30 and leaf spring 36 are pressed against or near the cushion 34 and the actuation device 30 is in contact with the synthesizer trigger 32.

The synthesizer trigger 32 includes a rubberized shock pad 52 that is sandwiched between a housing 54 and contains an electrical transducer 55, which can be of the piezoelectric type, or other means for supplying an electrical signal to the synthesizer such as a force sensing resistor, and a support plate 56. The shock pad 52 can also be a series of rubberized pads or any number of shock absorbers. It tends to eliminate extraneous vibrations which might otherwise be sensed by the transducer and reduce the possibility of damage to the transducer caused by sudden, repetitious impacts with the actuation device 30. Moreover it adds flexibility to the device, thereby providing the musician with more of the "natural feel" which is characteristic of a high quality acoustic drum pedal as its beater strikes the membrane of a drum.

The housing 54 faces the leaf spring 36. The transducer therein is adapted to convert the vibrational energy transmitted as a result of the actuation device 30 striking the housing 54 into electrical signals which can be transferred to a synthesizer 55. The transducer also has a wire 58 which is connected to a lightweight input connector 60 that in turn can be connected to a synthesizer 11 by suitable electrical wires 59. The input connector 60 is located adjacent to the synthesizer trigger 32 and is fastened to the base 14 by a nylon hook and eye fabric (not shown), sold under the trademark VELCRO, which is wrapped around the connector 60 and is secured to a VELCRO type strip 63. This ensures that the connector 6 will not become dislodged from the base 14 during transportation of the device or under operating conditions. Consequently, the device 10 is less likely to become inoperable due to the wire 58 becoming detached from the connector 60 or the transducer. Damage to the transducer tends to be avoided.

Figure 3:
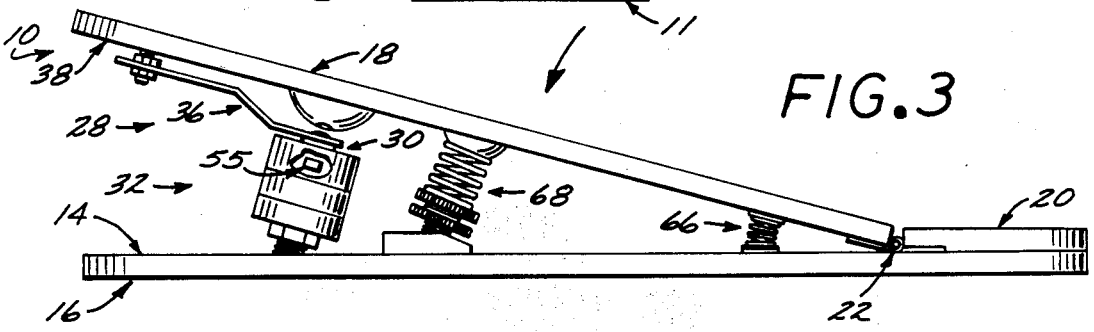
FIG. 3 is a side view of the device of FIG. 1 under operating conditions.

The synthesizer trigger 32 is secured to the base 14 by a threaded bolt 62 having an adjustable nut 64 that abuts the support plate 56. By turning the nut 64, the musician can adjust the height of the synthesizer trigger 32 relative to the leaf spring 36. As a result, the musician can select an operating condition which is most comfortable and provides optimum performance characteristics for him. The synthesizer trigger 32 is further obliquely oriented, relative to the base 14 of the device 10. As such the actuation device 30 can flushly strike the housing 54 as shown in FIG. 3.

The embodiment of the device shown in FIG. 2 also includes a second biasing element 66, such as a coil spring, and an adjustable biasing mechanism 68 which, along with the resisting mechanism 28 and synthesizer trigger 32, tend to provide the musician with the "natural feel" of an acoustic drum pedal. The second biasing element 66 is advantageously, but not necessarily, situated near the latch mechanism 22 and has each of its ends securely, but releasably, capped by annular studs 70. The studs can be secured to the foot plate 18 and the base 14 by any one of three pairs 72, 74 and 76 of set screws located along the longitudinal axes of the foot plate 18 and the base 14. This gives the musician the capability to alter his playing style by simply adjusting the position of the second biasing element 66. This adjustability feature, together with the resiliency of the second biasing element 66, helps the device 10 emulate the type of bouncing and rocking motion and overall "natural feel" which is characteristic of a high quality acoustic drum pedal. It can also contribute to the musician's playing comfort by relieving some of the stress to the user's leg caused by the repititous contact between the actuation device 30 and the synthesizer trigger 32.

The adjustable biasing mechanism 68 includes a spring 78 capped by a first internally threaded disc 80 which is separated from a second internally threaded disc 82. Both discs 80 and 82 are threaded onto an externally threaded bolt 84, which is connected to the base 14 of the device 10, and protrudes obliquely upward relative to the base 14. The second disc 82 is, however, threaded onto the bolt 84 ahead of the first disc 80 and at a location beneath the first disc 80 in order to lock the spring in place and prevent slippage during operation.

A shock pad 86 which is advantageously hemispherical, but can have any number of other shapes, is connected to the underside 38 of the foot plate 18 and opposite the free end of the spring 78. When the foot plate 18 is depressed, it comes into contact with the spring 78 and tends to reduce noise and to cushion the shock to the adjustable biasing mechanism 68 caused by the sudden and repetitious motion of the foot plate 18. It also tends to reduce vibration which might otherwise accidentally activate the transducer 55.

The adjustable biasing mechanism 68 is advantageously adjustable along its longitudinal axis by simply threading one or both of the discs 80 and 82 along the bolt 84. As such, the musician can alter the distance between the foot plate 18 in its rest position and the adjustable biasing mechanism 68 in its rest position. It will be appreciated that this adjustability feature permits the musician to effectively adjust the arresting of the downward movement of the foot plate 18 at selected stages of the pivotal movement of the foot plate 18. Further, it allows the musician to adjust the synthesizer trigger rate, which is the rate at which the actuation device 30 impacts the synthesizer trigger 32, thereby activating the synthesizer 11. Consequently, the musician can alter his playing rhythm.

The operation of the embodiment of the present invention shown in FIGS. 2 and 3 will now be described. Preliminarily, the musician has the option of adjusting the device 10 to suit his particular playing style and ensure that the "natural feel" of the device is satisfactory. To that end, he can adjust the height of the synthesizer trigger 32 relative to the actuation device 30 by turning the adjustable nut 64. He may also adjust the trigger rate through adjusting the adjustable biasing mechanism 68 in the manner described above. For example, the mechanism 68 may be adjusted such that it nearly abuts the foot plate 18 in the foot plate's 18 rest position or instead impacts the foot plate 18 at some stage during its depression. During this stage of fine tuning the device, the synthesizer trigger 32 advantageously will not sense acoustic vibrations stemming from the adjustable biasing mechanism 68 or angular movement of the foot plate 18 unless the actuation device 30 impacts the synthesizer trigger 32. Finally, the musician may fine tune the bouncing and rocking motion of the device 10 through adjustment of the second biasing element 66 as described above.

The musician then assumes the playing position by positioning his foot on the foot pedal 12 and depressing the foot plate 18. As he continues to depress the foot plate 18, it eventually compresses the spring 78 of the adjustable biasing mechanism 68 which in turn impedes the angular movement of the foot plate 18. As this movement continues, the actuation device 30 eventually strikes the housing 54 of the transducer, thereby energizing the transducer. This impact triggers an electrical signal which proceeds through the wire 58 to the input connector 60 which transfers the signal to the synthesizer 11 through the wires 59.

Upon impact, the actuation device, and consequently the foot plate 18, "overtravels." That is, instead of making an inelastic impact with the housing 54 the leaf spring 36 of the resisting mechanism 28 permits the actuation device 30 to resiliently flex upon impact until it is eventually arrested by the rubberized stop cushion 34. As such, the leaf spring 36 provides an ever increasing resistance to the impact force until its spring force is totally expended through absorption by the rubberized stop cushion 34. At the same time, the leaf spring 36 resists the overtravel movement of the foot plate 18. As the pressure on the foot plate 18 is relieved by the musician's arching his foot upward, the actuation device 30 and leaf spring 36 separate from the housing 54 and return to their normal positions.

It will thus be appreciated that the device emulates the operation of a high quality acoustic drum pedal used on an acoustic drum. More particularly, as the foot pedal of such a drum pedal is depressed such that its beater strikes the membrane of the drum, the membrane resiliently flexes due to the impact with the beater until it reaches point of maximum flexure. As the pressure on the foot pedal is relieved, the beater separates from the membrane and the membrane returns to its normal position. Likewise, as explained above the actuation device 30 with the aid of the leaf spring 36 resiliently flexes and then returns to its normal position. As a result, the device tends to minimize the occurrence of "drum pad knee."

Moreover, as with an acoustic drum pedal, percussive sounds are immediately triggered when the actuating device 30 strikes the transducer 55. There is no need to rely on vibration sensing devices which are located within the drum and which tend to inaccurately sense the vibration of the membrane as well as extraneous vibrations.

Figure 4:
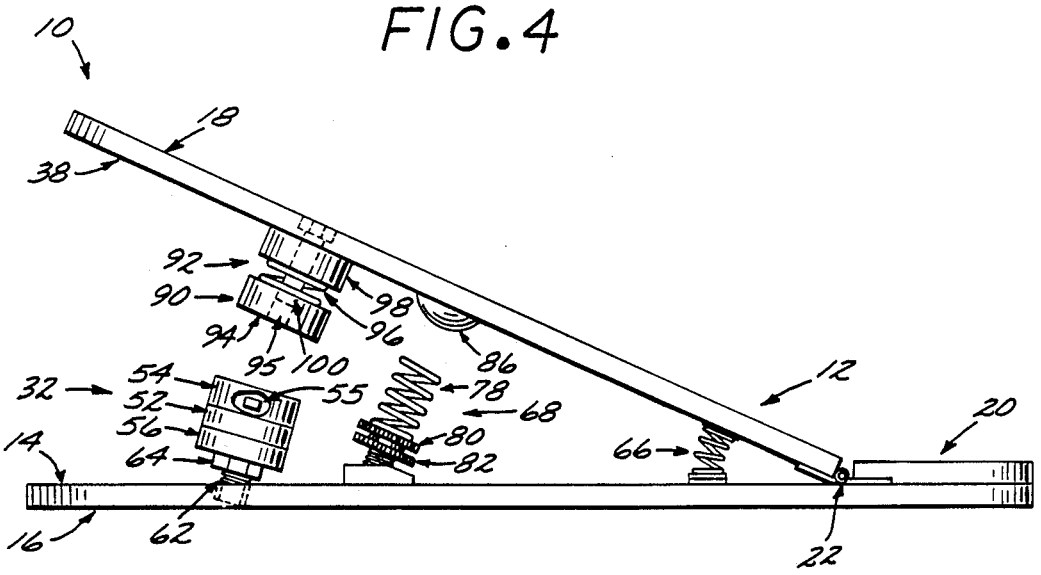
FIG. 4 is a side view of an alternative embodiment of the device of FIG. 1.

An alternative embodiment of a means by which the pedal device 10 triggers and controls the production of synthesized percussive sounds is shown in FIG. 4. It has the same synthesizer trigger 32 of FIG. 2 but uses a different actuation device 90 and resisting mechanism 92. Specifically, the actuation device 90 includes a striker 94, which can be a plate or block shaped member. The resisting mechanism 92 includes a resilient biasing element 96, which can be a coil spring, that is capped on one end by an energy absorbing member 98 and on the other end by the striker 94 which has a bore 95. The energy absorbing member 98 is secured to the underside 38 of the upper portion of the foot plate 18, and tends to reduce the shock which the striker 94 experiences upon impact with the synthesizer trigger 32.

A guiding pin 100 is also included which passes through longitudinal axes of the resilient biasing element 96 and the energy absorbing member 98 and is secured to the foot plate 18. The pin 100 is also adapted to be received within the bore 95, such that the striker 94 can slide along the pin 100. The pin 100 tends to stabilize the actuation device 90 during operating conditions and to prevent the shape of the resilient biasing element 96 from becoming irreparably distorted from frequent impacts. As a result, the actuation device 90 is able to repeatedly, squarely strike the synthesizer trigger 32. Costs and frequency of maintenance tend to be reduced. Moreover, as shown in FIG. 4, the second biasing element 66 and the adjustable biasing mechanism 68 can also be used.

The operation of the alternative embodiment of FIG. 4 is substantially the same as that of the embodiment of FIGS. 2 and 3. When the foot plate 18 is depressed, the striker 94 of the actuation device 90 strikes the housing 54 of synthesizer trigger 32, thereby activating the synthesizer 11.

Figure 5:
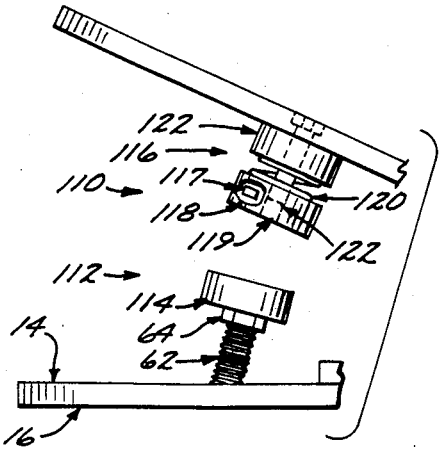
FIG. 5 is a sectional side view of an alternative embodiment of the device of FIG. 1, taken along the line 3—3.

Still another alternative embodiment of a means by which the device 10 triggers and controls the production of synthesized percussive sounds is shown in FIG. 5. It is somewhat similar to that described in the embodiment of FIG. 4, except that the positions of the striker and housing with its transducer are reversed and the particular housing-shock pad arrangement is not used. More particularly, the embodiment of FIG. 5 includes a synthesizer trigger 110, an actuation device 112 having a striker 114, and a resisting mechanism 116. The synthesizer trigger 110 includes a housing 118 which contains a transducer 117 and a bore 119. The resisting mechanism 116 includes a resilient biasing element 120 capped on one end by an energy absorbing member 122 and on the other end by the synthesizer trigger 110. A guiding pin 122 is also included again for similar purposes. Here, however, it permits the synthesizer trigger 116 to repeatedly squarely strike the striker 114.

The actuation device 112 of the embodiment of FIG. 5 is secured to the base 14 by the threaded bolt 62 with nut 64 similarly to that described in conjunction with bolt 62 and nut 64 of the embodiment of FIGS. 2 and 3. The height of the actuation device 112 relative to the base 14 can also be adjusted in the same fashion.

The operation of the alternative embodiment of FIG. 5 is substantially the same as that of the embodiment of FIGS. 2 and 3 and FIG. 5. Here, however, the actuation device 114 is stationary during operating conditions, while the synthesizer trigger 110 moves along with the foot plate 18. More particularly, as the musician depresses the foot plate 18, the synthesizer trigger 110 eventually strikes the striker 114. This impact immediately causes the transducer to transmit an electrical signal to the synthesizer 11 through the input connector (not shown in FIG. 5). As the pressure on the foot plate is then relieved by the musician's arching his foot upward, the synthesizer trigger 110 assumes its normal rest position. In this case, the fact that the synthesizer trigger 110 is connected to the resisting mechanism 116 also tends to reduce the shock to the transducer 117 from repeated impacts and prevent damage to it.

Figure 6:
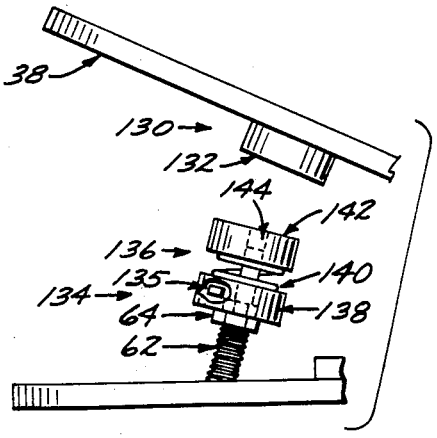
FIG. 6 is a sectional wide view of an alternative embodiment of the device of FIG. 1, taken along the line 3—3.

Still another alternative embodiment of a means by which the device 10 triggers and controls the production of synthesized percussive sounds is shown in FIG. 6. It is somewhat similar to the embodiment of FIG. 5 and includes an actuation device 130 having a striker 132, a synthesizer trigger 134, and a resisting mechanism 136. The striker 132 is a simple block which can be rubberized and which is connected to the underside 38 of the upper portion of the foot plate 18.

The synthesizer trigger 134 includes a transducer 135 contained within a housing 138. It is secured to the base 14 at an oblique angle relative to the base 14 by the threaded bolt 62 capped by the nut 64 in a manner similar to that described for the embodiment of FIGS. 2 and 3. The resisting mechanism includes a resilient biasing element 140, which can be a coil spring, capped on one end by the synthesizer trigger 134 and on the other end by a plate 142 which faces the striker 132 and has a bore 144. The resilient biasing element can be reinforced by a guiding pin a stated above.

The operation of the alternative embodiment of FIG. 6 is substantially the same as that of FIGS. 2 and 3. Here, however, the actuation device 130 directly strikes the plate 142 rather than the housing 138 that contains the transducer as in FIGS. 2–4. As a result, the vibrations which trigger the transducer 135 must be transmitted through an additional medium, the resisting mechanism 136, which also cushions shock to the transducer and the user of the device 10.

It will thus be appreciated that the present invention provides for a pedal device for immediately and accurately triggering and controlling a synthesizer without at the same time tending to produce "drum pad knee" or to impair the musicians playing style. The device permits the musician to adjust his playing positions and style and tends to emulate the highly desirable "natural feel" of quality acoustic drum pedals.

Although the invention has been described in detail with reference to the presently preferred embodiments, it will be appreciated by those skilled in the art that various modifications can be made without departing from the spirit and scope of the invention. Accordingly, the invention is limited only by the following claims.

I claim:

1. A drum pedal device for triggering and controlling a synthesizer, comprising:

transducer means for supplying an electrical signal to said synthesizer;

actuation means for actuating said transducer means upon impact between said transducer means and said actuation means;

a movable pedal coupled to said actuation means to cause said impact between said actuation means and said transducer means upon movement of said pedal, said pedal being adapted for overtravel movement after said impact occurs; and resisting means for resiliently resisting said overtravel movement after actuation of said transducer means, thereby simulating the action of an acoustic drum pedal.

2. The device of claim 1 wherein said resisting means opposes movement of said pedal with increasing force as said overtravel progresses.

3. The device of claim 1, wherein said resisting means includes a leaf spring.

4. The device of claim 3, wherein said actuation means includes a striker attached to said leaf spring.

5. The device of claim 1, wherein said resisting means includes a resilient biasing element capped on one end by an energy absorbing member; and said actuation means includes a striker which caps the other end of said biasing element.

6. The device of claim 5, wherein said resisting means further includes a guide pin means, secured to said pedal and surrounded by said biasing element, for stabilizing said actuation means and retaining the shape of said biasing element.

7. The device of claim 1, wherein said resisting means includes a resilient biasing element capped at one end by said transducer means and at the other end by an energy absorbing member.

8. The device of claim 7, wherein said resisting means further includes guide pin means, secured to said transducer means and surrounded by said biasing element, for stabilizing said actuation means and retaining the shape of said biasing element.

9. The device of claim 1, wherein said resisting means includes a biasing element capped by a plate.

10. The device of claim 9, wherein said resisting means includes guide pin means, secured to said transducer means and surrounded by said biasing element, for stabilizing said actuation means and retaining the shape of said biasing element.

11. The device of claim 1 further comprising:

a housing which contains said transducer means;

a support plate; and a shock pad for cushioning shock to said transducer, said pad being arranged between said housing and said plate.

12. The device of claim 1, further including:

a base to which said pedal is pivotally connected; and biasing means for controlling and imparting bouncing and rocking motion to said pedal, said biasing means being located toward the rear of said pedal and said base and being connected to said pedal and said base.

13. The device of claim 12 wherein said biasing means includes a spring capped on one end by an annular stud connected to said pedal and on the other end by an annular stud connected to said base.

14. The device of claim 12 wherein said base defines a series of bores spaced longitudinally along said base and said pedal for optionally receiving said biasing means.

15. The device of claim 1, further including:

a base to which said pedal is pivotally connected; and adjustable biasing means secured to said base and facing said pedal for arresting the downward movement of said pedal at selected stages of the pivotal movement of said pedal relative to said base.

16. The device of claim 15, wherein said adjustable biasing means includes:

an externally threaded member secured to said base and facing said pedal; and an adjustable spring capped at one end by a first internally threaded disc which is received by said theaded member, said spring being capable of having its position adjusted by threading said disc along said threaded member.

17. The device of claim 16, wherein said adjustable biasing means further includes means located along said threaded member for locking said adjustable spring in place.

18. The device of claim 16, wherein said adjustable biasing means further includes a shock pad secured to said pedal and facing the free end of said spring.

* * * * *